United States Patent [19]

Vodopia

[11] Patent Number: 4,882,587

[45] Date of Patent: Nov. 21, 1989

[54] ELECTRONICALLY ROLL STABILIZED AND RECONFIGURABLE ACTIVE ARRAY SYSTEM

[75] Inventor: Samuel N. Vodopia, Santa Monica, Calif.

[73] Assignee: Hughes Aircraft Company, Los Angeles, Calif.

[21] Appl. No.: 44,638

[22] Filed: Apr. 29, 1987

[51] Int. Cl.[4] ..... H01Q 3/22

[52] U.S. Cl. ..... 342/372; 342/152; 342/377

[58] Field of Search ..... 342/371, 372, 373, 374, 342/377, 383, 384, 74–75, 77, 357, 359

[56] References Cited

U.S. PATENT DOCUMENTS

| | | | |
|---|---|---|---|
| 3,202,992 | 8/1965 | Kent et al. | 342/372 |
| 3,345,631 | 10/1967 | Chamberlin, Jr. . | |
| 3,403,401 | 9/1968 | Cragon et al. . | |
| 3,652,978 | 3/1972 | Halliday et al. | 342/372 X |
| 3,729,742 | 4/1973 | Boyns | 342/374 |
| 3,938,610 | 2/1976 | Mailloux et al. . | |
| 3,940,770 | 2/1976 | Fassets et al. | 342/374 X |
| 3,943,523 | 3/1976 | Fassett . | |
| 3,953,857 | 4/1976 | Jenks | 342/373 X |
| 3,965,475 | 6/1976 | Deerkoski et al. . | |
| 4,607,259 | 8/1986 | Dragone | 342/421 X |
| 4,734,700 | 3/1988 | Brunner | 342/373 |
| 4,792,805 | 12/1988 | Miglia | 342/372 |

OTHER PUBLICATIONS

U.S. patent application No. 07/043,406, for "Multifunction Active Array," Egidio Miglia, filed Apr. 28, 1987.

*Primary Examiner*—Thomas H. Tarcza
*Assistant Examiner*—Tod R. Swann
*Attorney, Agent, or Firm*—Leonard A. Alkov; Wanda Denson-Low

[57] ABSTRACT

An active array system is disclosed with electronic roll stabilization of the difference patterns, and with arbitrary partitioning of the phase scanned aperture with no hardware changes. The array system comprises a large number of radiating elements forming the array, with individual transmit/receive active modules coupled to each radiating element. In each active module, the received signal is amplified and then divided into three signal components. Two of the signal components are passed through a bi-state phase shifter for selectively phase shifting the signal component by 0 to 180 degrees. The selectively phase shifted receive signals are then coupled to the respective azimuth and elevation difference channels. The third signal component is coupled to the sum channel network. The respective sum and difference channels all provide summing functions on the respective sum and difference signals from each module. The phase shifters provide an output signal with either a positive or negative sign, so that in effect the module signals are "differenced" first and then summed.

19 Claims, 3 Drawing Sheets

ELECTRONICALLY ROLL STABILIZED AND RECONFIGURABLE ACTIVE ARRAY SYSTEM

BACKGROUND OF THE INVENTION

The invention relates to techniques for electronically varying the partitioning of planar arrays or phase scanned arrays into sub-arrays, and in particular to an improved technique for providing electronic roll stabilization of the array difference patterns.

The method generally used to generate sum and difference patterns in gimballed planar arrays or phased scanned arrays is to partition the array into quadrants with a separate output for each. The appropriate quadrant outputs are summed or differenced to provide a sum pattern and two difference patterns. The two difference patterns provide tracking error signals referenced to the antenna.

In many airborne radar modes, in particular the terrain following and terrain avoidance modes, difference patterns stabilized with respect to the horizon are required. The current solution to this problem is either to provide a third gimbal or to implement rather cumbersome and not entirely satisfactory signal processing to derive roll stabilized tracking outputs. The roll gimbal technique is probably not feasible for active array systems of sufficient size to require liquid cooling. An alternative to the signal processing approach is needed.

It would therefore represent an advance in the art to provide an electronically roll stabilized active array without the need for mechanical roll gimbals or cumbersome signal processing.

SUMMARY OF THE INVENTION

An active array system is disclosed for electronic roll stabilization of the array difference patterns. The array comprises a plurality of radiative elements for receiving electromagnetic radiation, and a corresponding plurality of active modules coupled to the respective elements. Each module includes an active amplifier for amplifying the signal received at the element, and a three-way power divider for dividing the received signal in three components. A first component is fed into a first bi-phase phase shifter which shifts the phase of the first component by 0 or 180 degrees. A second component is fed into a second bi-phase phase shifter which shifts the phase of the second component by 0 or 180 degrees.

The output of the first phase shifter is coupled to a first array summing network which sums the respective phase-shifted first components from all the modules in the array to provide a first difference signal. The resulting signal is in effect the difference between the sum of those first component signals having a 0 degree phase shift and the sum of those first component signals having a 180 degree phase shift.

The output from the second phase shifter of each module is coupled to a second array summing network which sums these phase-shifted second components to provide a second difference signal. The resulting signal is in effect the difference between the sum of those second component signals having a 0 degree phase shift and the sum of those second component signals having a 180 degree phase shift.

The third component from the power divider is fed directly into a third summing network for summation with the corresponding third components from all the array modules to provide an array sum signal.

A phase shifter controller is coupled to the first and second bi-state phase shifters of each module to select the state of each phase shifter, in dependence on attitude position data. By selecting the state of the phase shifters, the partition assignment of each radiative element may be adjusted to compensate for rolling or rotation of the array boresight in relation to a nominal position.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
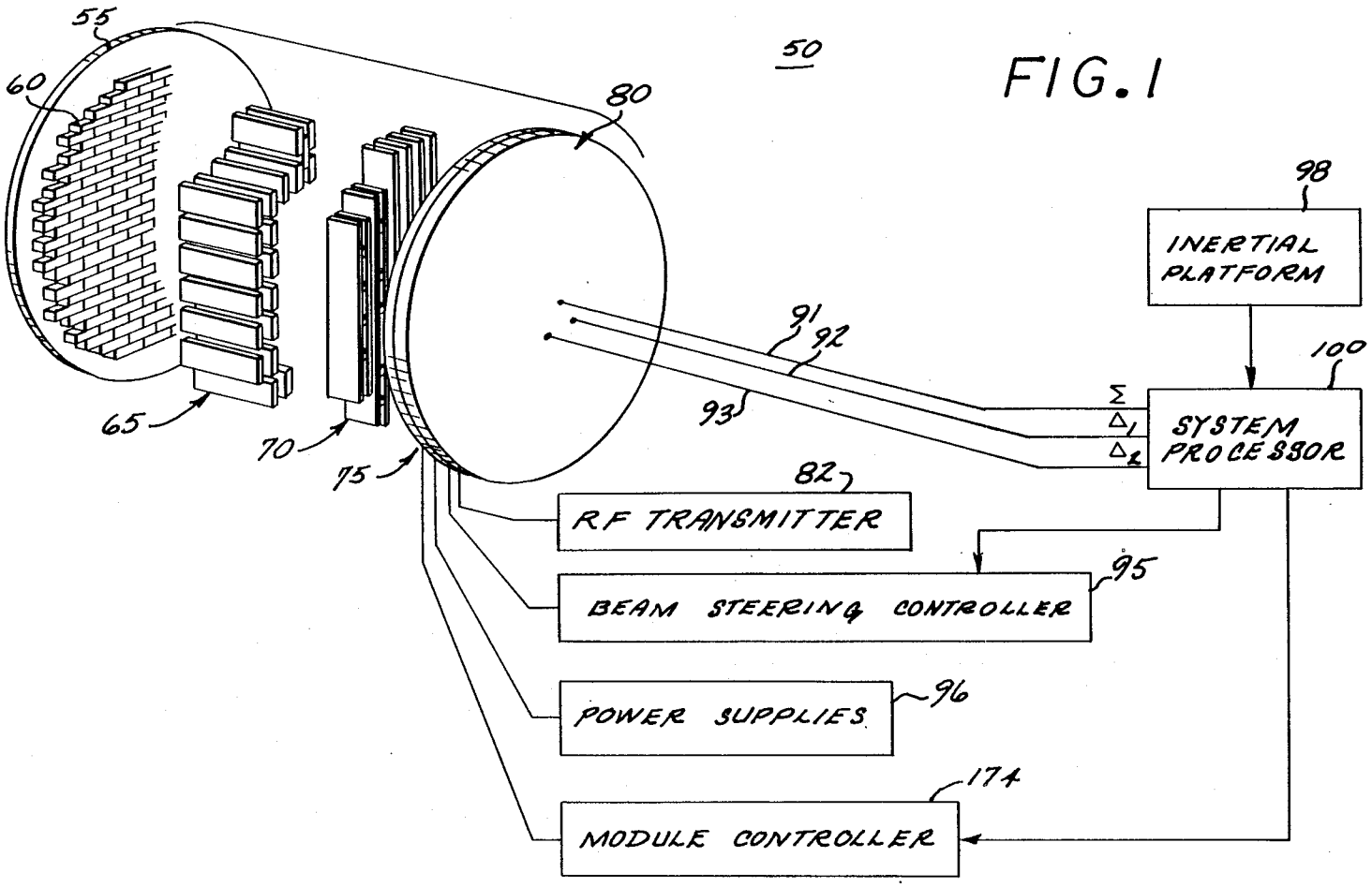
FIG. 1 is a perspective diagrammatic view of a phased array system with which the present invention may be implemented.

One of the primary advantages of active array systems is that both the RF source and the receiver preamplifiers are associated with each radiating element in the array, thereby negating the effects of RF feed and phase shifter losses. This is illustrated in FIG. 1, a functional depiction of an active array system 50. The radiating aperture 55 comprises a large number of radiative elements indicated generally as elements 60 disposed at the planar aperture 55. The array further comprises a plurality of transmit/receive (T/R) modules 65, one for each of the radiating elements 60. Respective transmit/-receive (T/R) modules 65 are electrically coupled between each radiative element 60 and the RF manifolds 80. Liquid cold plate devices 70 cool the T/R modules 65. For clarity, only some of the radiating elements 60, T/R modules 65 and cold plate devices 70 comprising the system 50 are depicted in FIG. 1.

The DC and control signal manifolds 75 distribute DC power and control signals to control the module functions of the T/R active modules. Thus, signals from the beam steering controller 95, power supplies 96 and T/R module controller 174 are coupled to the manifold 75 for distribution to the T/R modules 65. Beam steering controller 95 is directed by system controller 100 to steer the beams produced by the array to a desired direction. Module controller 174 controls the operation of the modules 65 as directed by controller 100, as described more fully below.

The RF manifolds 80 distribute RF excitation signals to the T/R modules 65, and collect the received RF signals from the modules. Thus, the manifolds 80 comprise a transmit manifold 80A (FIG. 2) for distributing RF excitation signals to the modules 65, and three combining manifolds 80B–80D (FIG. 2) for combining respective receive RF signals from the modules 65, as will be described in more detail below. The outputs of the respective receive manifolds 80B–80D comprise the sum ($\Sigma$), first difference ($\Delta_1$), and second difference ($\Delta_2$) channel outputs, and are coupled to system processor 100 on lines 91–93.

The elements 55, 65, 70, 75 and 80 are depicted in FIG. 1 to form an exploded perspective view. As will be appreciated by those skilled in the art, these elements are assembled to form an integrated, compact assembly.

In a phased array system such as system 50 shown in FIG. 1, the effect of both phase shifter and corporate feed losses in system performance can be reduced to negligible levels by increasing the gains of the low power level stages of the transmit and receive modules 65. This characteristic of active array systems can be exploited to provide roll stabilized difference patterns in accordance with the invention.

Figure 2:
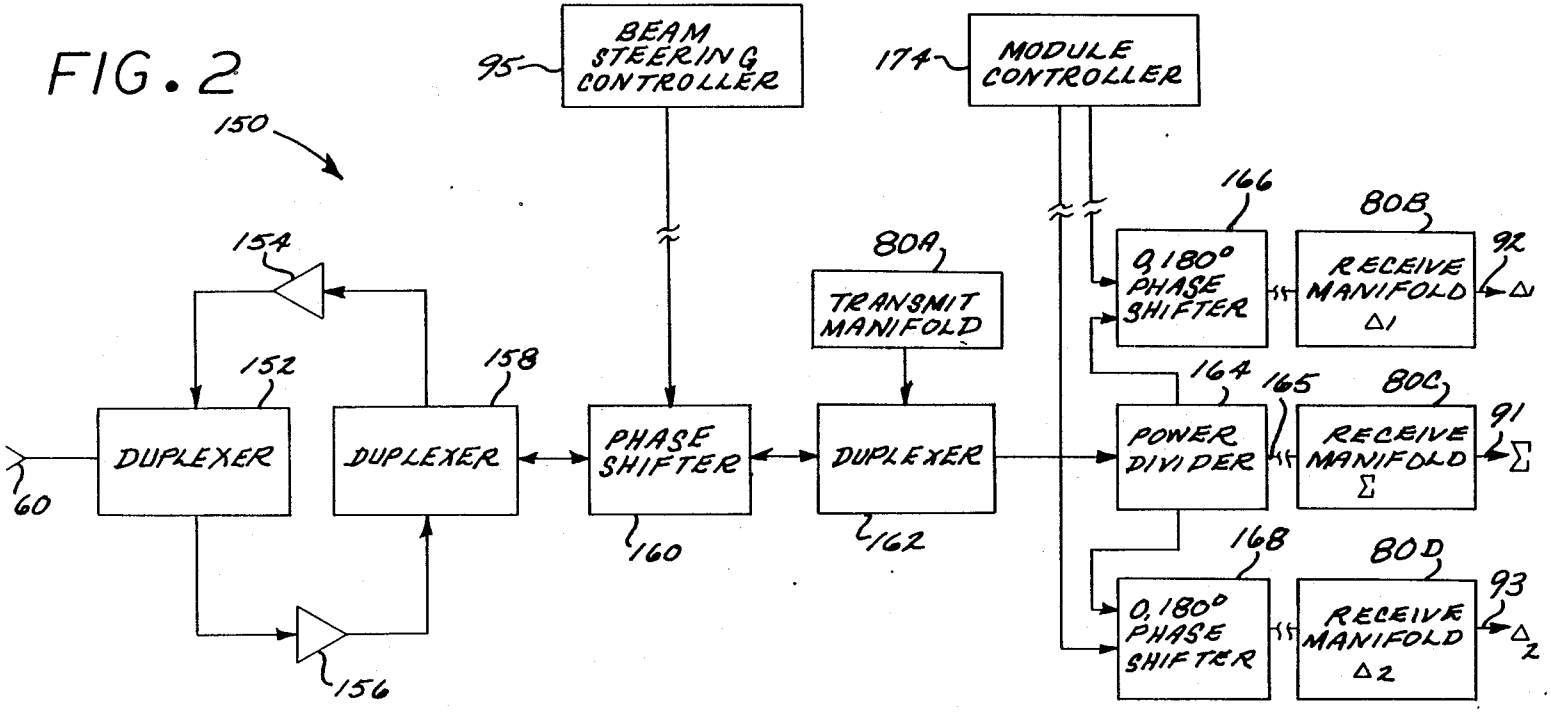
FIG. 2 is a functional block diagram of a typical module employing the invention.

FIG. 2 is a schematic block diagram of an active array module 150 that may be used in an active array system to provide roll stabilized difference patterns in accordance with the invention. The module comprises circulator/duplexer 152 coupled to the corresponding radiative element 60 for separating the respective received and transmit signals. The received signals are coupled from duplexer 152 to low noise amplifier 156 for amplification. The amplified received signal is passed through the duplexer 158, the beam steering phase shifter 160 and circulator/duplexer 162 to power divider 164. The divider 164 splits the amplified received signal into three signal components, including one supplied to bi-state phase shifter 166, and another component to bi-state phase shifter 168. The possible states of the bi-state phase shifters 166, 168 are 0 and 180 degrees, respectively. The output of phase shifter 166 is the first component signal for the module, and is coupled to the first RF manifold ($\Delta_1$) network 80B. The output of phase shifter 168 is the second component signal for the module and is coupled to the second RF manifold ($\Delta_2$) 80D. The output of the divider 164 on line 165 is the third component signal for the module, and is coupled directly to the third RF manifold ($\Sigma$) 80C without any phase correction.

The purpose of bi-state phase shifters 166, 168 is to provide a received RF signal component with either a positive or negative sign. A difference pattern with any roll orientation is provided by changing the sign of the appropriate module output signals and then summing all the corresponding output signals from each T/R module 65. In effect, the module output signals are first differenced and then summed, rather than being summed first and then differenced as is done in the conventional corporate feed networks to provide a difference pattern. Thus, each of the first and second networks 80B, 80D provides a summation of the respective module difference outputs. The resulting signal at the output of manifold 80B (the first difference channel) is in effect the difference between the sum of those first component signals from all T/R modules having a 0 degree phase shift and the sum of those first component signals having a 180 degree phase shift. Similarly, the resulting signal at the output of manifold 80D (the second difference channel) is in effect the difference between the sum of those second component signals from all T/R modules having a 0 degree phase shift and the sum of those second component signals having a 180 degree phase shift.

The transmit signal is provided from the transmit RF manifold 85 to duplexer 162, and passes through beam steering phase shifter 160 to duplexer 158, which directs the transmit signals to power amplifier 154. The amplified transmit signal is then coupled through duplexer 152 to the radiative element 60.

Beam steering controller 95 provides beam steering signals to beam steering phase shifter 160 in the conventional manner.

Module controller 174 is coupled to bi-state phase shifters 166, 168 to control the phase shifts introduced by the elements in dependence on attitude position signals, provided, in the case of an airborne system, from the aircraft inertial platform 98. These signals are indicative of the attitude of the array in relation to the horizon.

The power divider 164 does not significantly reduce the signal-to-noise ratio of the system because the noise figure has been established by the low noise amplifier 156 that precedes it.

Figure 3:
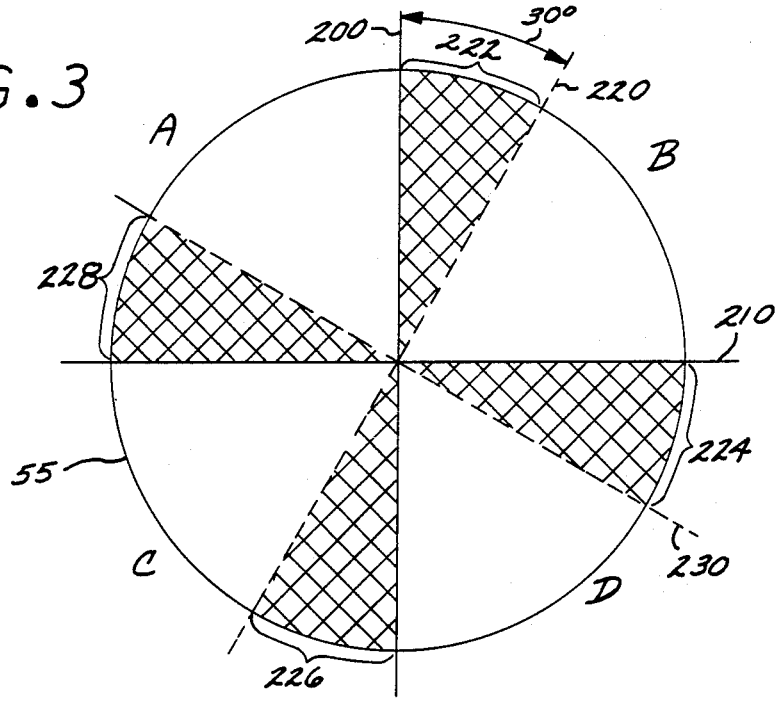
FIG. 3 is a diagrammatic depiction of roll stabilized quadrants for providing azimuth and elevation difference patterns.

Referring now to FIG. 3, a quadrant-partitioned aperture for providing azimuth and elevation difference patterns is depicted in diagrammatic form. As is well known in the art, many radar systems employ two or more displaced radiating/receive elements (or groups of elements) so that each receives the signal from a point source at a slightly different phase. The received signals from each receive element (or group) are summed to form the array sum signal, and the received signal from one element (or group) is subtracted from the signal received on the other element (or group) to form a difference signal. The difference signal is a measure of the relative location of the target from the array boresight, since the difference signal will be nulled if the boresight is perfectly aligned on the target.

Difference signals are typically provided in the azimuth and elevation directions. Thus, the azimuth difference signal indicates the angular offset of the boresight from the target along the azimuth axis, with the sign of the signal indicating the direction of the offset. Similarly, the magnitude and sign of the elevation difference signal indicates the angular offset of the boresight from the target along the orthogonal elevation axis.

The quadrant partitioning of the aperture 55 shown in FIG. 3 may be employed with system 50 to provide the azimuth and elevation difference signals. Thus, the radiative elements 60 of the array are adaptively associated with a respective one of the quadrants A, B, C, and D. Assume that axis 200 is aligned with the elevation axis, and that orthogonal axis 210 is aligned with the azimuth axis. To form the azimuth difference signal, the combined contributions from the signals received by the radiating elements in the B and D quadrants are subtracted from the combined signals received by the radiating elements in the A and C quadrants. The elevation difference signal is provided by subtracting the combined signals received at the radiating elements in the C and D quadrants from the combined signals received at the elements in the A and B quadrants.

The invention provides a means of arbitrarily assigning a particular radiating element to a particular quadrant of the array without requiring changes in hard wired connections or complex signal processing. The array controller is provided with attitude position data, e.g., from the aircraft inertial platform 98 in the case of an aircraft-mounted active array. This data may be used to direct the module control logic 174 to set the bi-phase phase shifters 166, 168 to the correct state for the particular roll angle, e.g., with the first difference component at the output of phase shifters 166 corresponding to the azimuth difference module signal, and the second difference signal at the output of phase shifter 168 corresponding to the elevation difference module signal.

This may be appreciated with reference to FIG. 3. Assume that the aircraft roll axis is initially aligned with azimuth axis 210. For all modules associated with radiating elements in the A quadrant, the phase shifters 166 and 168 are set to the 0 degree phase shift state. For all modules associated with radiating elements in the B quadrant, the phase shifter 166 (azimuth difference) are set to the 180 degree phase shift position to associate a minus sign with the signal contribution from these elements, and the phase shifter 168 (elevation difference) is set to the 0 degree state.

For all modules associated with radiating elements in the C quadrant, the phase shifters 166 (azimuth difference) are set to the 0 degree state, and the phase shifters 168 (elevation difference) are set to the 180 degree position. For all modules associated with radiating elements in the in the D quadrant, the phase shifters 166 and 168 are both set to the 180 degree phase shift state.

Now assume that the aircraft rolls to a 30 degree angle with respect to the azimuth axis, such that the aircraft axes are aligned with phantom lines 220 and 230 shown in FIG. 3. To roll stabilize the array with the horizon, the quadrant positions of certain of the radiating elements are reassigned. Thus, the radiating elements located in the cross-hatched sector 222, nominally in the A quadrant for the case when the aircraft is aligned with the horizon, are reassigned to the B quadrant. Similarly, the radiating elements in sector 224, nominally in sector D, are reassigned to the B quadrant. The radiating elements in sector 226, formerly in D quadrant, are reassigned to the C quadrant. The radiating elements in sector 228, formerly in quadrant C, are reassigned to sector A.

To implement the reassignment of radiating elements requires only that the states of the phase shifters 166, 168 of the modules associated with the reassigned elements to be adjusted to the states described above for the radiating elements in the respective quadrants. With the array controller, this reassignment may be achieved very quickly. Thus, the difference pattern of the array may be electronically roll stabilized, without the need for mechanical roll gimbals or complex signal processing.

Figure 4:
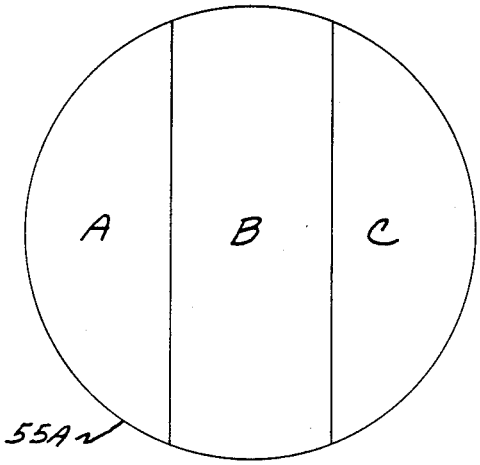
FIG. 4 is a diagrammatic depiction of three sector partitioning of the array to provide three apertures for low speed moving target indication (MTI) functions, "cross eye" jammer tracking, and close spaced (in azimuth) target tracking.
Figure 5:
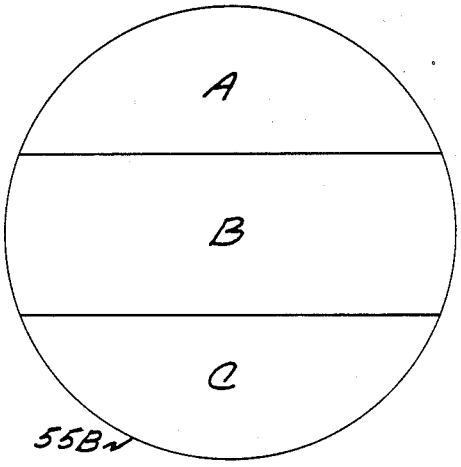
FIG. 5 is a diagrammatic depiction of three sector partitioning of the array to provide multipath reduction capabilities and close spaced (in elevation) target tracking.

As an alternative to providing sum and difference signal patterns, an active array implemented with the roll stabilization modules described in FIG. 2 can be used to provide three independent receiving apertures. FIGS. 4 and 5 shows circular apertures 55A and 55B partitioned into three separate receiving apertures A, B, C required in a number of applications such as low speed moving target tracking, negating cross-eyed jammers, resolving closely spaced (in azimuth) targets (FIG. 4), or reducing multipath interference and resolving closely spaced (in elevation) targets (FIG. 5). The three summing network output signals corresponding to the sums of the respective sum, first difference and second difference module components, are $$\Sigma = A + B + C \quad (1)$$

$$\Delta_1 = A + B + (-C) \quad (2)$$

$$\Delta_2 = A + (-B) + C \quad (3)$$

where the minus sign in Eq. 2 indicates that all the module component signals in the C segment of the array feeding the first difference combining manifold 80B have a 180 degree phase shift (phase shifters 166) and the minus sign in Eq. 3 indicates that all the module component signals in the B segment of the array feeding the second difference combining manifold 80D have a 180 degree phase shift (phase shifter 168). The following computations are performed in the signal processor on the three RF manifold signals to separate the signals received from the radiating elements in the respective A, B and C segments of the array:

$$A = (\Delta_1 + \Delta_2)/2 = ((A+B-C)+(A-B+C))/2$$

$$B = (\Sigma - \Delta_2)/2 = ((A+B+C)-(A-B+C))/2$$

$$C = (\Sigma - \Delta_1)/2 = ((A+B+C)-(A+B-C))/2$$

The shape and orientation of the A, B, C portions of the array can be varied at will with no hardware modifications, simply by altering the states of respective ones of the phase shifters 166, 168.

An active array system has been described for providing an electronically roll-stabilized and partitioned receive aperture.

It is understood that the above-described embodiment is merely illustrative of the possible specific embodiments which may represent principles of the present invention. Other arrangements may be devised in accordance with these principles by those skilled in the art without departing from the scope of the invention.

What is claimed is:

1. An active array system for providing electronically roll stabilized array difference patterns, comprising:

an array of spaced radiative elements forming a radiative aperture for receiving electromagnetic radiation;

a plurality of active modules respectively coupled one each to each radiative element, each module comprising a first means for selectively phase shifting the radiation received at the corresponding radiative element by relative phase shifts of substantially 0 degrees or 180 degrees in dependence on a first module control signal to provide a first module receive signal;

means for combining the respective first module receive signals to provide a first difference channel output signal;

means for providing attitude position signals representing the relative attitude position of the array in relation to a reference position; and control means responsive to said attitude position signals for providing respective first module control signals to each of said plurality of modules for selectively controlling said first phase shifting means of each module to selectively and independently phase shift the radiation received at each radiative element so as to roll stabilize said first difference channel output signal in relation to said reference position.

2. The active array system of claim 1 wherein said control means adaptively partitions said aperture into roll-stabilized sectors and adaptively assigns each radiative element to a particular one of said sectors in dependence on said attitude position signals by controlling the state of said first phase shifting means.

3. The active array system of claim 1 wherein each of said modules further comprises a second phase shifting means for selectively phase shifting the radiation received at the corresponding radiative element by relative phase shifts of substantially 0 degrees or 180 degrees to provide a second module receive signal, said system further comprises means for combining the respective second module receive signals to provide a second difference channel output signal, and wherein said control means further comprises means responsive to said attitude position signals for providing respective second module control signals to each of said plurality of modules for selectively controlling said respective second phase shifting means of each module to selectively and independently phase shift the radiation received at each radiative element so as to roll stabilize said second difference channel output signal in relation to said reference position.

4. The active array system of claim 3 wherein said reference position is aligned with the azimuth, and said first difference channel output signal represents a roll-stabilized azimuth difference signal and said second difference channel output signal represents a roll-stabilized elevation difference signal.

5. The active array system of claim 4 wherein said control means partitions said array into roll-stabilized quadrant sectors and for each of the first and second difference channels adaptively assigns each radiative element to a particular quadrant by controlling the states of said first and second phase shifting means.

6. The active array system of claim 1 wherein said array of spaced radiative elements are disposed in a plane to provide a planar array.

7. An airborne active array system mounted in an aircraft or other airborne vehicle for providing electronically roll stabilized array difference patterns, comprising:

a plurality of spaced radiative elements forming a radiative aperture for receiving electromagnetic radiation:

means for providing attitude position signals representing the relative attitude position of the vehicle in relation to a reference position;

a plurality of active modules respectively coupled one to each radiative element, each of said modules comprising an active amplifier for providing an amplified receive signal for the respective element, power dividing means for dividing the power of the amplified signal into first, second and third receive signal components, and first and second bi-state phase shifting means for respectively and selectively phase shifting the first and second amplified signal component by 0 degrees or 180 degrees in dependence of first and second bi-state control signals to provide first and second module difference signal components;

first summing network for summing the respective first difference signal components from each module in the array to provide a first array difference signal;

second summing network for summing the respective second difference signal components from each module in the array to provide a second array difference signal; and phase shifter control means for generating said first and second bi-state control signals and independently controlling said first and second phase shifters of each module in dependence on said attitude position signals to selectively and independently phase shift said first and second amplified signal components so as to roll stabilize the first and second difference patterns in relation to said reference position.

8. The array system of claim 7 further comprising a third summing network for summing the respective third signal components from the respective power dividers to provide an array sum signal.

9. The array system of claim 7 wherein said radiative aperture is partitioned into roll-adapted quadrant sectors, and wherein said control means is adapted to set the first bi-state phase shifters of the modules associated with radiative elements in first and second adjacent quadrants to the 0 degree state, and those first bi-state phase shifters of the modules associated with radiative elements in the remaining adjacent third and fourth quadrants to the 180 degree state.

10. The array system of claim 9 wherein said control means is further adapted to set the second bi-state phase shifters of the modules associated with radiative elements in the adjacent first and fourth quadrants to the 0 degree state, and those second bi-state phase shifters of modules associated with radiative elements in the adjacent second and fourth quadrants to the 180 degree state.

11. The array system of claim 10 wherein said control means adaptively reconfigures the quadrant relationship of each radiative element in response to said attitude position signals by setting the bi-state phase shifters in the associated module to the appropriate state.

12. The active array system of claim 7 wherein said plurality of spaced radiative elements are disposed in a plane to provide a planar array.

13. An active array system usable in a multimode radar for simultaneously forming three independent electronically reconfigurable receive apertures from an active array radiative aperture, comprising a plurality of spaced radiative elements forming said radiative aperture for receiving electromagnetic radiation;

a plurality of active modules respectively coupled one to a radiative element, each of said modules comprising an active amplifier for providing an amplified receive signal for the respective element, power dividing means for dividing the power of the amplified signal into first, second and third receive signal components, said first signal component providing a first module output signal, and first and second bi-state phase shifting means for selectively and independently shifting the second and third signal components by 0 degrees or 180 degrees in dependence on first and second control signals to provide second and third module output signals;

first summing network coupled to said plurality of modules for summing the respective first module output signals to provide an array sum signal;

second summing network coupled to said plurality of modules for summing the respective second module output signals to provide a first difference signal;

third summing network coupled to said plurality of modules for summing the respective third module output signals to provide a second difference signal; and system processor for selecting an aperture configuration of said three apertures required by a particular mode in a multimode radar system, said processor adapted to provide said first and second control signals so as to selectively and independently shift the phase of said second and third signal components by 0° or 180°, said processor arranged to process said sum signals and said first and second difference signals to provide first, second, and third independent aperture signals.

14. The array system of claim 13 wherein said system processor comprises means for summing said first and second difference signals and dividing the sum by two to form a first aperture receive signal.

15. The array system of claim 13 wherein said system processor comprises means for substracting the second difference signal from the sum signal and dividing the difference by one-half to form a second aperture receive signal.

16. The array system of claim 13 wherein said system processor comprises means for substracting said second difference signal from said sum signal and dividing the difference signal by one-half to form a third aperture receive signal.

17. The array system of claim 13 further comprising means for providing attitude position signals representing the relative attitude position of said array in relation to a reference position, and wherein said system processor adaptively reconfigures the aperture relationship of each radiative element in response to said attitude position signals by setting the bi-state phase shifters in the associated module to the appropriate state in order to roll stabilize said three apertures.

18. The active array of claim 13 further comprising means for providing attitude position signals representing the relative attitude position of said array in relation to a reference position, said system processor being responsive to said attitude position signals to roll stabilize said respective apertures in relation to said reference position.

19. The active array system of claim 13 wherein said plurality of spaced radiative elements are disposed in a plane to provide a planar array.

* * * * *